US012673232B2

(12) United States Patent
Muth et al.

(10) Patent No.: US 12,673,232 B2
(45) Date of Patent: Jul. 7, 2026

(54) MULTIPURPOSE WORKOUT AND STORAGE BENCH

(71) Applicant: FITBENCH, LLC, Ixonia, WI (US)

(72) Inventors: Jim Muth, Hutisford, WI (US); Tyler Danen, Oconomowoc, WI (US)

( * ) Notice: Subject to any disclaimer, the term of this patent is extended or adjusted under 35 U.S.C. 154(b) by 15 days.

(21) Appl. No.: 18/612,812

(22) Filed: Mar. 21, 2024

(65) Prior Publication Data

US 2024/0316393 A1 Sep. 26, 2024

Related U.S. Application Data

(60) Provisional application No. 63/453,530, filed on Mar. 21, 2023.

(51) Int. Cl.
*A63B 21/00* (2006.01)
*A63B 71/00* (2006.01)

(52) U.S. Cl.
CPC ..... *A63B 21/4029* (2015.10); *A63B 71/0036* (2013.01); *A63B 2210/00* (2013.01)

(58) Field of Classification Search
CPC ..... A63B 21/4029; A63B 71/0036; A63B 2210/00; A63B 2210/50; A63B 71/0622; A63B 2071/0694; A63B 2225/09
See application file for complete search history.

(56) References Cited

U.S. PATENT DOCUMENTS 2,258,782 A 10/1941 Mckean
D245,297 S 8/1977 Curtin
4,477,074 A 10/1984 Bushnell
5,050,861 A 9/1991 Thomas et al.
5,316,528 A 5/1994 Ziparo
D349,610 S 8/1994 Scott, Jr. et al.
5,551,936 A 9/1996 Parisi et al.
5,575,742 A 11/1996 Wu
5,611,762 A 3/1997 Kaye
5,772,561 A 6/1998 Hayden
5,855,536 A 1/1999 Wilkinson
D405,987 S 2/1999 Kuehn
5,997,442 A 12/1999 Cordes
D423,237 S 4/2000 Chang
(Continued)

FOREIGN PATENT DOCUMENTS

DE 20212161 1/2003
DE 20215421 3/2003
(Continued)

*Primary Examiner* — Andrew M Kobylarz
(74) *Attorney, Agent, or Firm* — Kritzer McPhee LLP

(57) ABSTRACT

A workout bench is disclosed with a movable bench top and storage containers. The workout bench is supported by a series of rubber gription pads which grip the support surface, preventing the bench from moving while in use. The bench comprises a retractable/extendable swivel caster. When the bench should be moved and/or relocated, the retractable/extendable swivel caster is engaged. A lifting swivel caster mechanism utilizes a series of linkages and levers that is activated by a push/pull toggle clamp. A visual indicator window indicates to the user that the unit is secure to the surface. The visual indicator bracket is a component of the linkage assembly and indicates the state of the linkage assembly to the user of the bench.

19 Claims, 9 Drawing Sheets

(56) References Cited

U.S. PATENT DOCUMENTS

| | | | | |
|---|---|---|---|---|
| 6,146,316 | A | 11/2000 | Carolus et al. | |
| D435,982 | S | 1/2001 | Gardner | |
| 6,245,001 | B1 | 6/2001 | Siaperas | |
| 6,454,683 | B1 | 9/2002 | Kaye | |
| 6,634,998 | B2 | 10/2003 | Siaperas | |
| 6,645,130 | B2 | 11/2003 | Webber | |
| D502,023 | S | 2/2005 | Anderson et al. | |
| 7,134,548 | B2 | 11/2006 | Meehan et al. | |
| 7,311,642 | B2 | 12/2007 | Li et al. | |
| 7,601,101 | B2 | 10/2009 | Jackson et al. | |
| 7,614,988 | B1 | 11/2009 | Kiser | |
| 7,651,452 | B2 | 1/2010 | Weir et al. | |
| 7,731,639 | B1 | 6/2010 | Shifferaw | |
| 7,914,424 | B1 | 3/2011 | Krull | |
| 8,403,134 | B1 | 3/2013 | Kantgias et al. | |
| 8,550,243 | B2 | 10/2013 | Moore | |
| 8,696,531 | B1 | 4/2014 | Spiller | |
| D703,971 | S | 5/2014 | Parisi et al. | |
| D705,574 | S | 5/2014 | Reid et al. | |
| 8,715,144 | B1 | 5/2014 | Friess et al. | |
| 9,022,907 | B2 | 5/2015 | Wang | |
| 9,061,172 | B1 | 6/2015 | Carrier | |
| 9,308,409 | B2 | 4/2016 | Beaver et al. | |
| 9,308,410 | B2 | 4/2016 | Beaver et al. | |
| 9,675,831 | B2 | 6/2017 | Beaver et al. | |
| 9,770,618 | B2 | 9/2017 | Wall | |
| D799,862 | S | 10/2017 | Laumerich et al. | |
| 9,878,198 | B2 | 1/2018 | Johnson | |
| D831,762 | S | 10/2018 | Donnelly et al. | |
| 10,092,791 | B2 | 10/2018 | Donnelly et al. | |
| 10,226,662 | B1 | 3/2019 | Mink | |
| 10,427,702 | B2 | 10/2019 | Phillips et al. | |
| D871,528 | S * | 12/2019 | Donnelly | D21/690 |
| 10,576,352 | B2 | 3/2020 | Vester | |
| 10,960,256 | B2 | 3/2021 | Donnelly et al. | |
| 12,208,303 | B2 * | 1/2025 | Leavitt | A63B 71/0036 |
| D1,085,294 | S * | 7/2025 | Tseng | D21/690 |
| 2002/0105156 | A1 | 8/2002 | Glidden | |
| 2003/0109364 | A1 | 6/2003 | Weir | |
| 2003/0186786 | A1 | 10/2003 | Hsu | |
| 2003/0224915 | A1 | 12/2003 | Charoenchit | |
| 2004/0014570 | A1 | 1/2004 | Centopani | |
| 2004/0082441 | A1 | 4/2004 | Kastelic | |
| 2005/0037905 | A1 | 2/2005 | Matos | |
| 2005/0148449 | A1 | 7/2005 | Weir et al. | |
| 2005/0164855 | A1 | 7/2005 | Li et al. | |
| 2006/0052220 | A1 | 3/2006 | Jackson et al. | |
| 2006/0100074 | A1 | 5/2006 | Murdoch | |
| 2006/0142129 | A1 | 6/2006 | Siaperas | |
| 2006/0293156 | A1 | 12/2006 | Trees | |
| 2007/0164525 | A1 | 7/2007 | Rodrigues | |
| 2007/0270292 | A1 | 11/2007 | Laney | |
| 2008/0023355 | A1 | 1/2008 | Reynolds | |
| 2008/0185805 | A1 | 8/2008 | Chen | |
| 2009/0065457 | A1 | 3/2009 | Kostigian | |
| 2009/0230644 | A1 | 9/2009 | Stanley | |
| 2011/0263397 | A1 | 10/2011 | Jackson | |
| 2012/0248047 | A1 | 10/2012 | Tanabe et al. | |
| 2013/0023392 | A1 | 1/2013 | Glickfield | |
| 2013/0213917 | A1 | 8/2013 | Rios Garcia Prieto | |
| 2014/0027223 | A1 | 1/2014 | Moore | |
| 2014/0243174 | A1 | 8/2014 | Alenaddaf | |
| 2015/0141218 | A1 | 5/2015 | Magrella | |
| 2015/0328494 | A1 | 11/2015 | Matthews | |
| 2016/0001116 | A1 | 1/2016 | Prusaitis | |
| 2016/0059104 | A1 | 3/2016 | Monaco | |
| 2017/0100622 | A1 | 4/2017 | Wall | |
| 2018/0133538 | A1 | 5/2018 | Jones et al. | |
| 2018/0236298 | A1 * | 8/2018 | Donnelly | A63B 21/0726 |
| 2019/0126122 | A1 * | 5/2019 | Vester | A63B 71/0036 |
| 2019/0240528 | A1 * | 8/2019 | Donnelly | A63B 21/4029 |
| 2021/0387041 | A1 * | 12/2021 | Rodriguez | A63B 21/4029 |

FOREIGN PATENT DOCUMENTS

| | | |
|---|---|---|
| GB | 2181658 | 4/1987 |
| GB | 2475567 | 5/2011 |
| WO | 2013072945 | 5/2013 |

* cited by examiner

MULTIPURPOSE WORKOUT AND STORAGE BENCH

CROSS-REFERENCE TO RELATED APPLICATION

This application claims priority to Provisional Application No. 63/453,530 filed on Mar. 21, 2023, which is hereby incorporated by reference.

BACKGROUND

The prior art includes: U.S. Pat. No. 10,960,256 (Oct. 25, 2017); U.S. Pat. No. 10,092,791 (Oct. 9, 2018); U.S. Pat. No. 6,454,683 (Sep. 9, 2002); U.S. Pat. No. 7,614,988 (Nov. 10, 2009); U.S. Pat. No. 7,311,642 (Dec. 25, 2007); U.S. Patent Application No. 20040014570 (Jan. 22, 2004); U.S. Pat. No. 4,477,074 (Oct. 16, 1984); U.S. Pat. No. 5,997,442 (Dec. 7, 1999); and U.S. Patent Application No. 20110263397 (Oct. 27, 2011). It is desirable to have an improved workout bench that is superior to any that is disclosed or suggested in the identified references.

SUMMARY

A workout bench is disclosed with a movable bench top and storage containers. The workout bench is supported by a series of rubber gription pads which grip the support surface, preventing the bench from moving while in use. The bench comprises a retractable/extendable swivel caster. When the bench should be moved and/or relocated, the retractable/extendable swivel caster is engaged. A lifting swivel caster mechanism utilizes a series of linkages and levers that is activated by a push/pull toggle clamp. A visual indicator window indicates to the user that the unit is secure to the surface. The visual indicator bracket is a component of the linkage assembly and indicates the state of the linkage assembly to the user of the bench.

BRIEF DESCRIPTION OF THE DRAWINGS

The detailed description makes reference to the accompanying figures wherein.

The figures are only intended to facilitate the description of the principles disclosed herein. The figures do not illustrate every aspect of the principles disclosed herein and do not limit the scope of the principles disclosed herein. Other objects, features, and characteristics will become more apparent upon consideration of the following detailed description.

DETAILED DESCRIPTION

A detailed illustration is disclosed herein. However, techniques, methods, processes, systems and operating structures in accordance with the principles disclosed herein may be embodied in a wide variety of forms and modes, some of which may be quite different from those disclosed herein. Consequently, the specific structural and functional details disclosed herein are merely representative.

Figure 1:
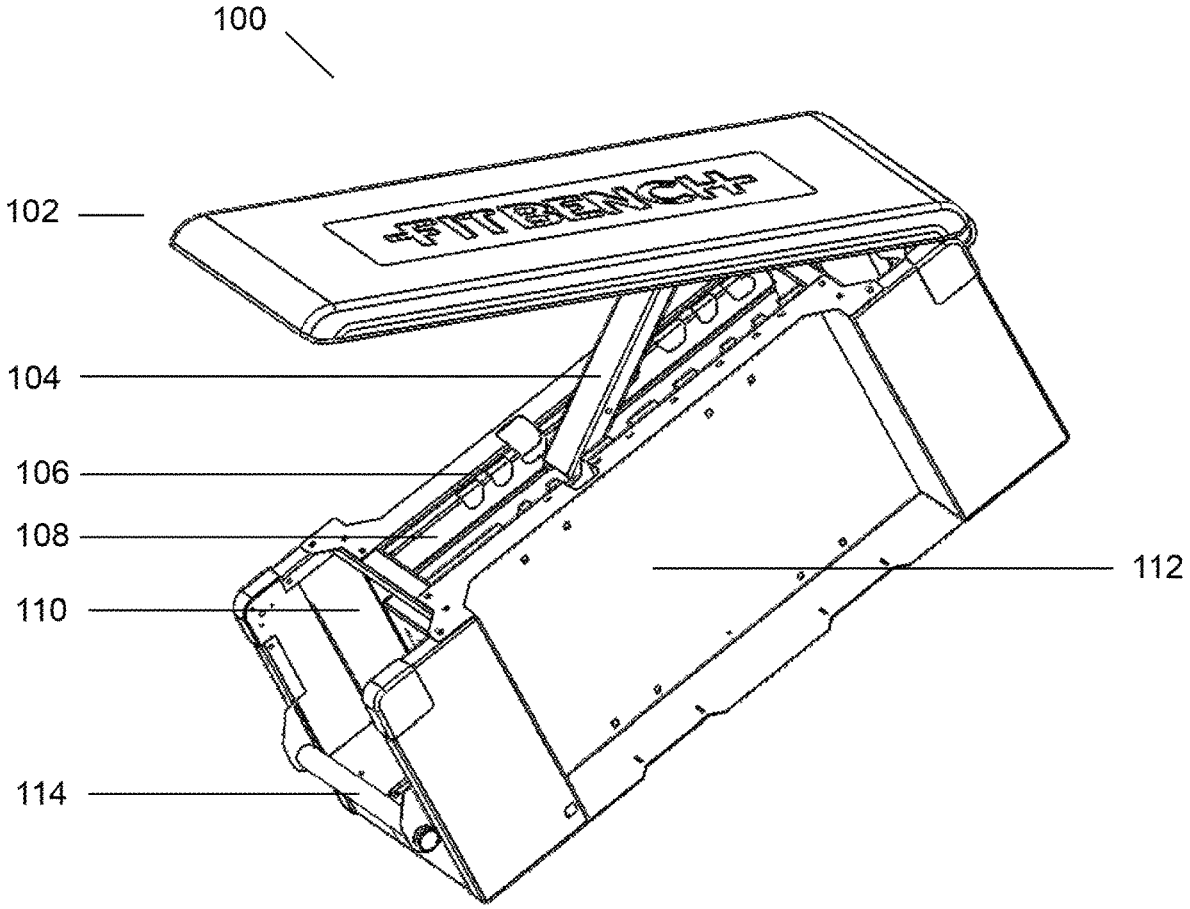
FIG. 1 illustrates a workout bench in accordance with the principles disclosed herein.
Figure 2:
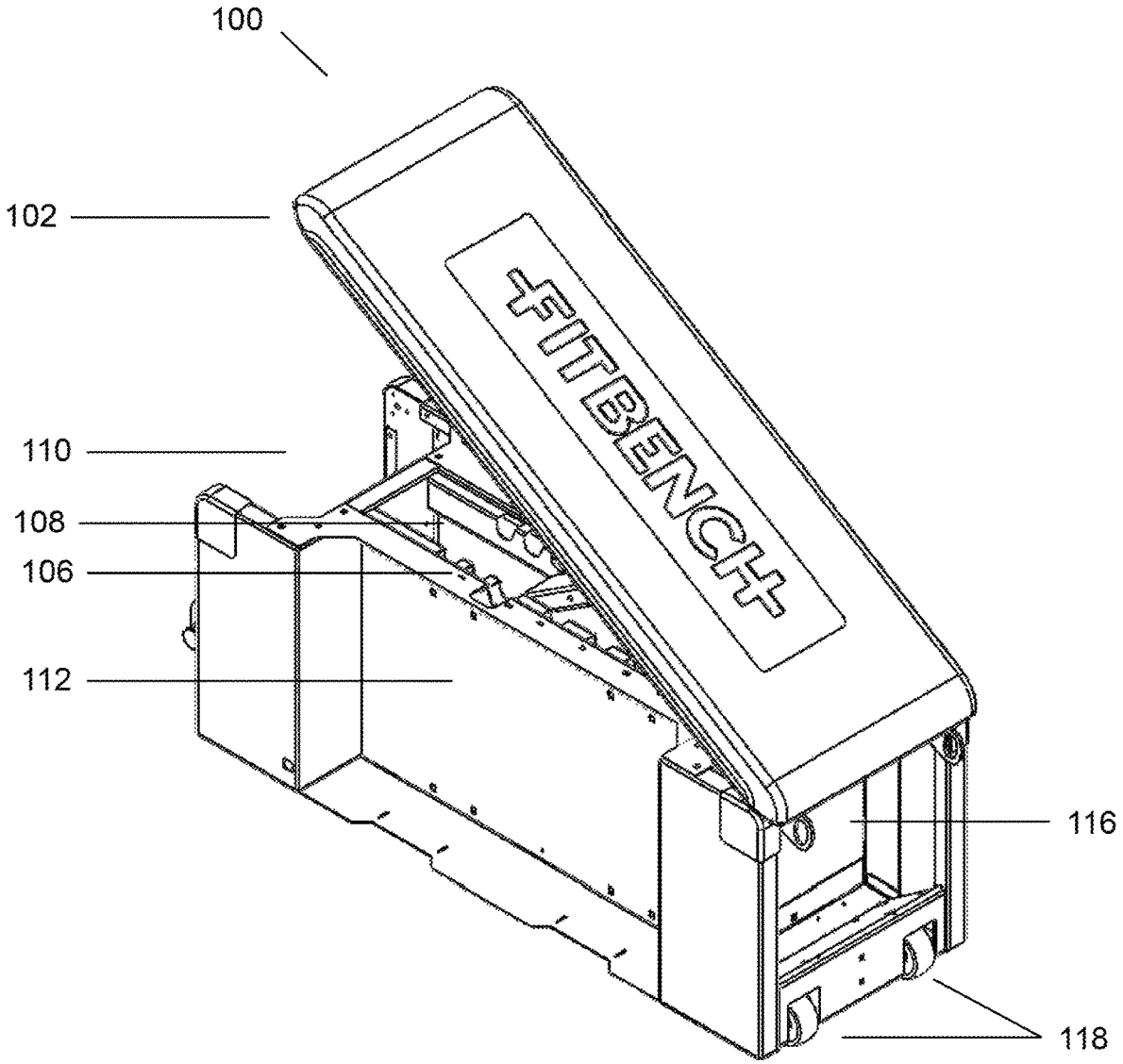
FIG. 2 illustrates another view of the workout bench shown in FIG. 1.

FIGS. 1 and 2 show a workout bench 100 for use by a person on a support surface and for holding a plurality of exercise items. The workout bench 100 comprises a rectanguloid front container 116 and a rectanguloid rear container 110 each connected with a rectanguloid side container 112 and an opposing rectanguloid side container (not shown). The front container 116 is at least partially open at a front side thereof, and the rear container 110 is at least partially open at a rear side thereof. Each side container (including side container 112) is open at an outward, lateral side thereof. The front container, the rear container, and the side containers are each flush at the top sides thereof, bottom sides thereof, and lateral sides thereof. Preferably, at least one bottle holder is fixed with at least one of the front container, the rear container, or the side containers. The front container, rear container, and side containers each define an internal storage volume therein. Preferably, the front container 116 further includes a first side door in at least one of the lateral sides thereof, the first side door being positionable between an open position for accessing the internal storage volume, and a closed position.

The workout bench 100 further comprises a benchtop 102 pivotally fixed with the front container 116 and including a selectively movable brace 104 for holding the benchtop at one of a plurality of predefined angular positions with respect to the top sides of the front container, the rear container, and the side containers. Preferably, a trough is defined between the side containers and flush with the top sides thereof. The trough contains a raised beam having a plurality of transverse notches 106 formed in a top side thereof. In this configuration, the movable brace 104 of the benchtop includes a cross bar adapted to fit within any of the notches, whereby each of the predefined angular positions of the benchtop correspond with the cross bar being engaged with one of the notches 106 of the trough. The rearmost notch corresponds with the benchtop lying flat on the front container, the rear container, and the side containers, and with the brace being fully contained within the trough. Wheels 118 are located on the front side of workout bench 100 and facilitate a user moving the bench across a support surface.

In addition, it is preferable that when the benchtop is lifted upwardly away from the front container and rear container, an internal storage volume 108 becomes accessible from the top side thereof. The internal storage volume 108 preferably includes a rear compartment isolated from the open front side of the front container by a dividing wall. In this configuration, the at least partially open front side of the front container includes a plurality of container baskets, which may be used to store exercise items. The rear compartment may further be accessible through the open top side of the front container or the front container's first side door in the open position. The exercise items may include, but are not limited to, dumbbell-type exercise items, resistance band-type exercise items, and kettle-bell-type exercise items. Each side container preferably further includes a plurality of dumbbell supports fixed with a back wall thereof, whereby the dumbbell-type exercise items may be supported on any of the dumbbell supports and removed from or returned to the side container through the open lateral side thereof.

Figure 3:
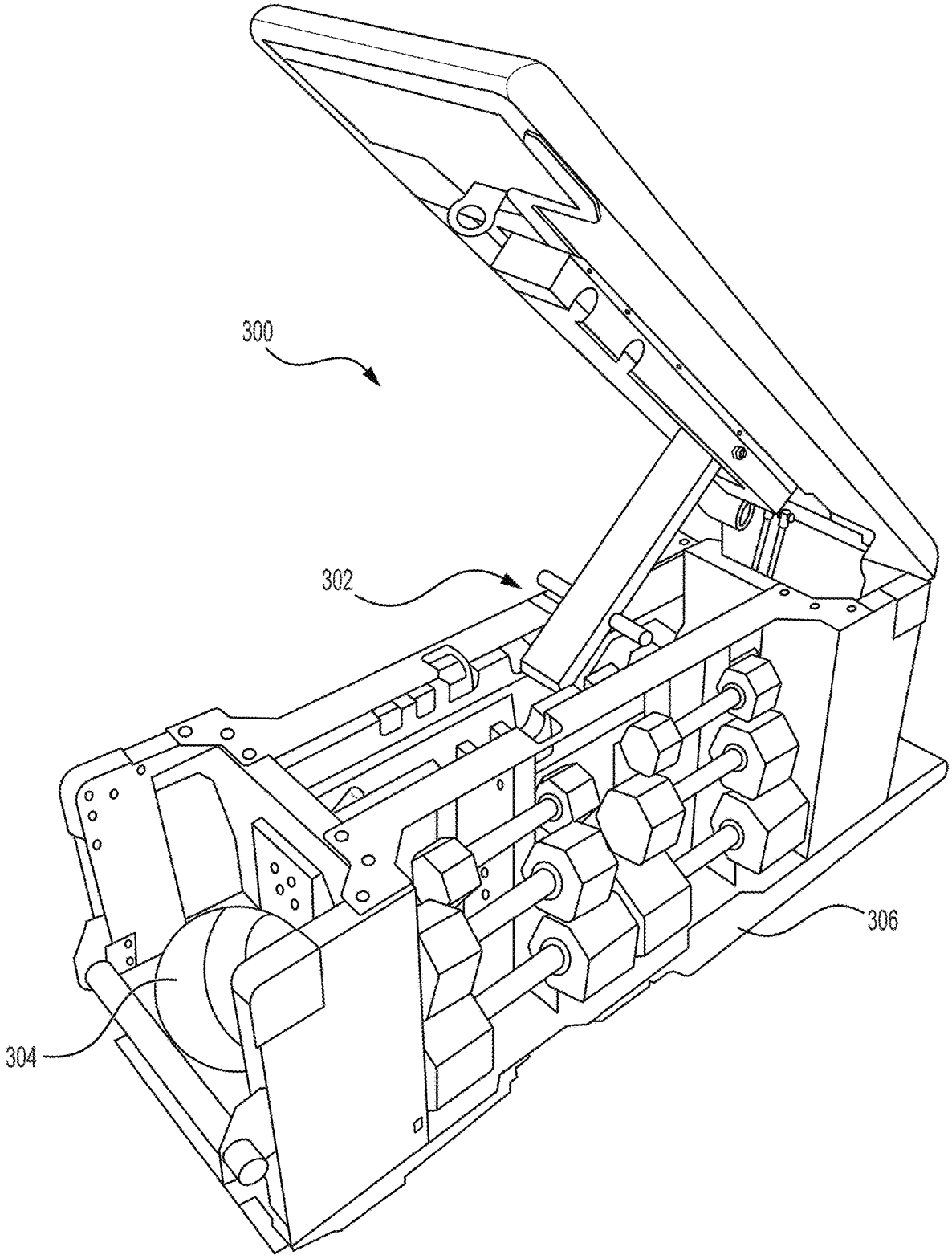
FIG. 3 illustrates a workout bench in accordance with the principles disclosed herein.
Figure 4:
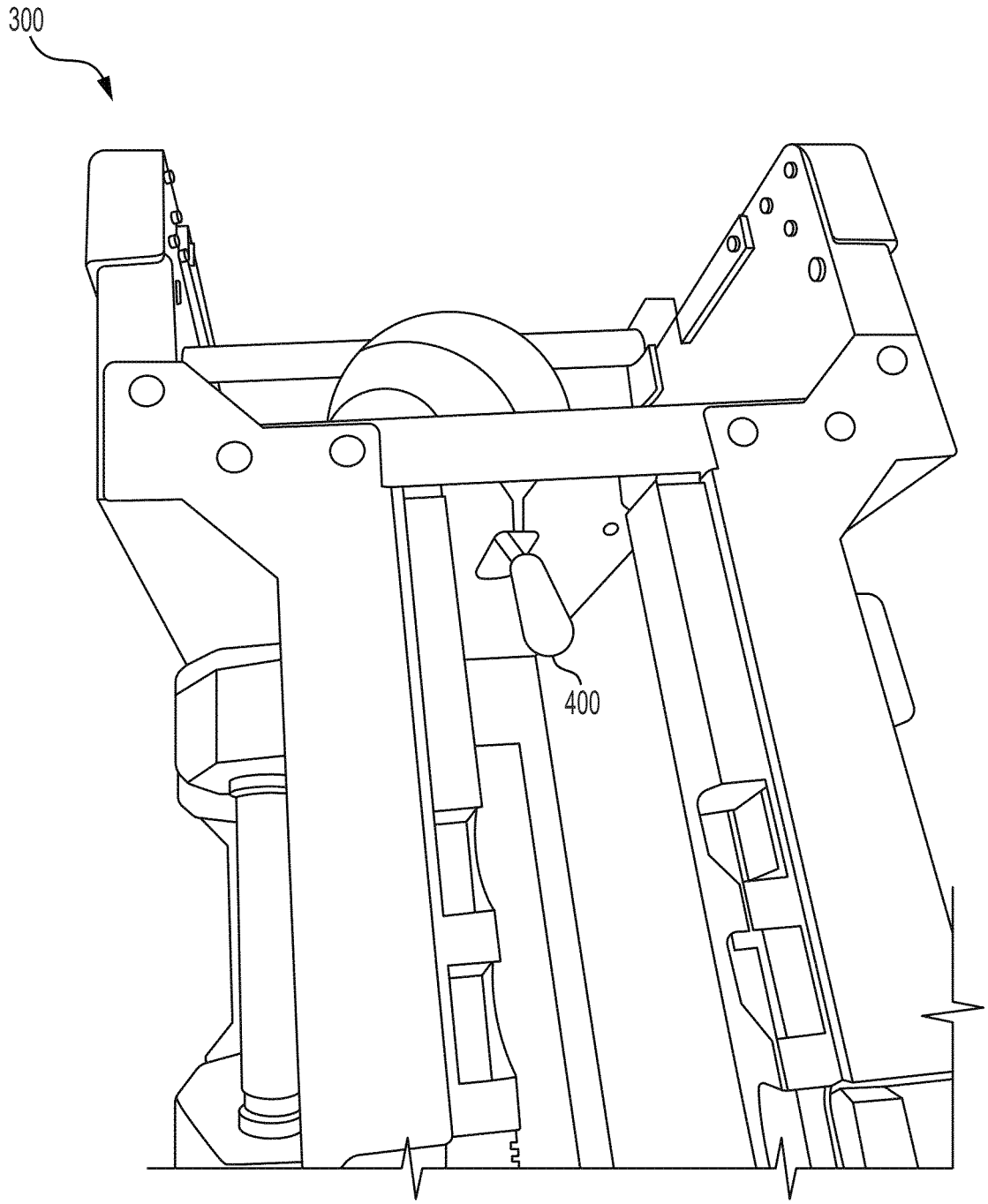
FIG. 4 illustrates another view of the workout bench shown in FIG. 3.
Figure 5:
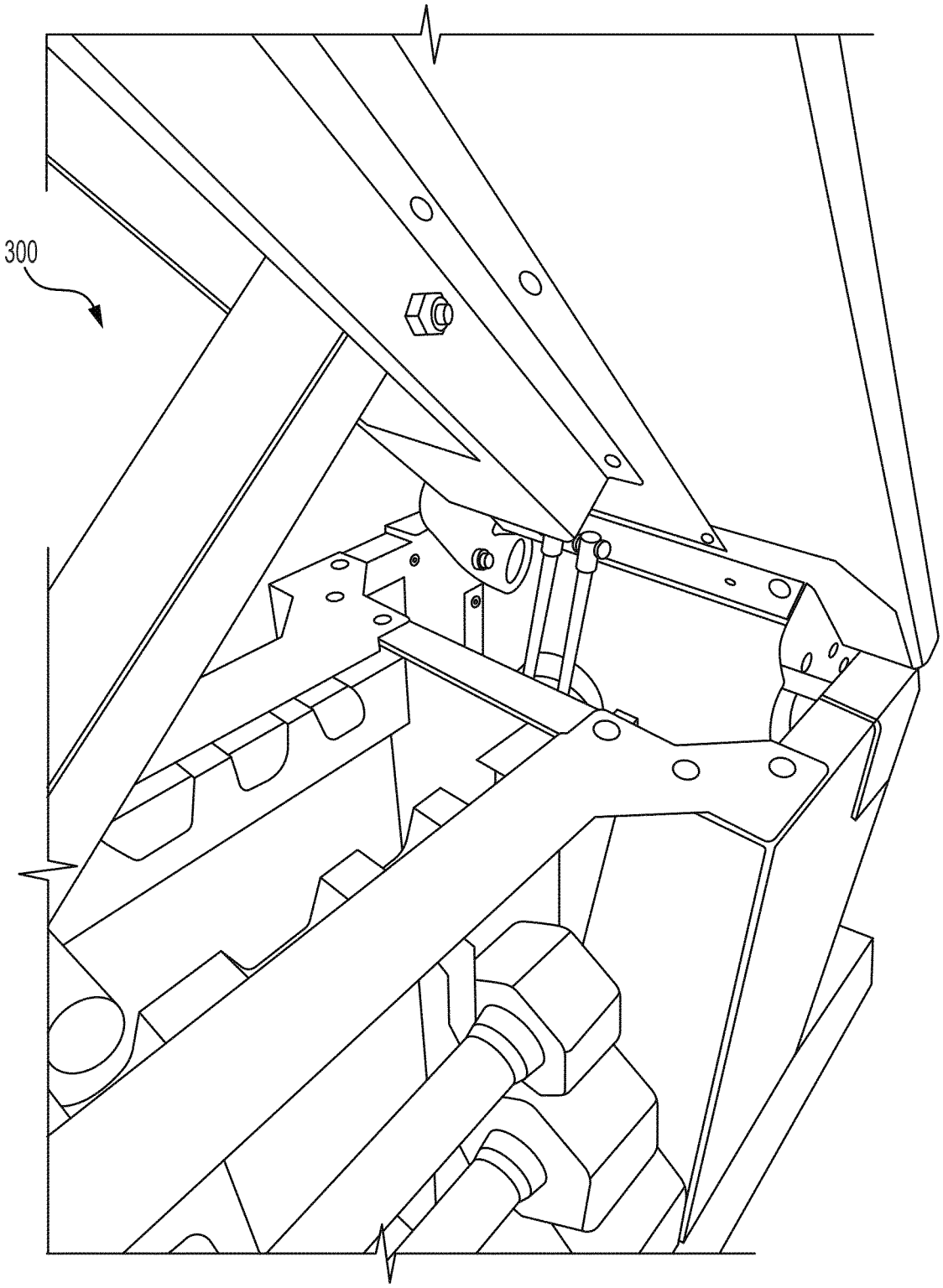
FIG. 5 illustrates another view of the workout bench shown in FIG. 3.

FIGS. 3, 4 and 5 show an embodiment of a workout bench 300 in accordance with the principles disclosed herein. When the benchtop is elevated, cross bar 302 sits in one of the notches to secure the brace in place. A medicine ball 304 is shown in the rear container, and dumbbells 306 are shown in one of the side containers.

A pair of wheels are fixed with the front container proximate the bottom side and front side thereof, and a handle is fixed with the rear container proximate the bottom side and the rear side thereof. The gription pads grip the support surface, preventing the bench from moving while in use. During some exercises, the bench experiences lateral forces, such as when the bench top is inclined and a user is pressing against it. In addition, lateral forces may be experienced when, for example, a user performs box jumps, push-ups, or resistance band exercises. If the bench is not secure to the floor (or other surface), the bench could slide due to the lateral forces, which may increase the risk of an injury. The gription pads prevent the bench from sliding when in use, which reduces the risk of an injury. The number of gription pads (2 to 8) can be changed in the field to accommodate different floor surfaces without the use of a tool or disassembly of the unit. Traditional leveling feet may not provide the adequate surface area or material composition to adequately secure the bench to the floor when in use.

The bench comprises a retractable/extendable swivel caster located in the front section of the bench. When the bench is not in use and it is desired to be moved and/or relocated, the retractable/extendable swivel caster is engaged. When engaged, it lifts the front end of the unit, disengaging the array of gription feet from the support surface, allowing the bench to be rolled to its desired position. Once the bench is in the desired position, the swivel caster is retracted, allowing the unit to be secured to the supporting surface. As shown, the push/pull toggle clamp 400 is accessible via the storage compartment of the bench and is accessed by opening the top. This location prevents the push/pull toggle clamp from being accidentally activated during exercises, which would put the bench in an unsafe condition. In alternative embodiments, a bench may have its lift device accessible from the exterior of the bench.

Visual indicator windows are located on both sides and rear of the bench that indicate to the user that the unit is secure to the surface. In some embodiments, a visual indicator window may be located on only one side, on only the rear, on both sides but not the rear, or on a combination of one side and the rear, without departing from the principles disclosed herein. In some embodiments, a visual indicator may also be located on the front of the bench, with or without visual indicators on the side(s) and/or rear of the bench. In the preferred embodiment, the visual indicator shows a green or red color and a lock or unlock icon in its window. A green color and/or lock icon indicates the bench is secure to the floor, and a red color and/or unlock icon indicates the bench is in its mobile mode and is unsafe to use for exercise. It should be appreciated that other colors, icons, symbols, or other suitable visual indicators may be used without departing from the principles disclosed herein.

The lifting swivel caster mechanism inside the workout bench 300 utilizes a series of linkages and levers (a linkage assembly) that is activated by push/pull toggle clamp 400 which provides a substantial mechanical advantage. As a result, the activation force to lift the end of the bench and engage the swivel caster is minimal. In addition the push/pull toggle clamp 400 locks the wheel in place when the caster is engaged to the support surface. The visual indicator bracket is a component of the linkage assembly and indicates the state of the linkage to the user of the bench.

Figure 6:
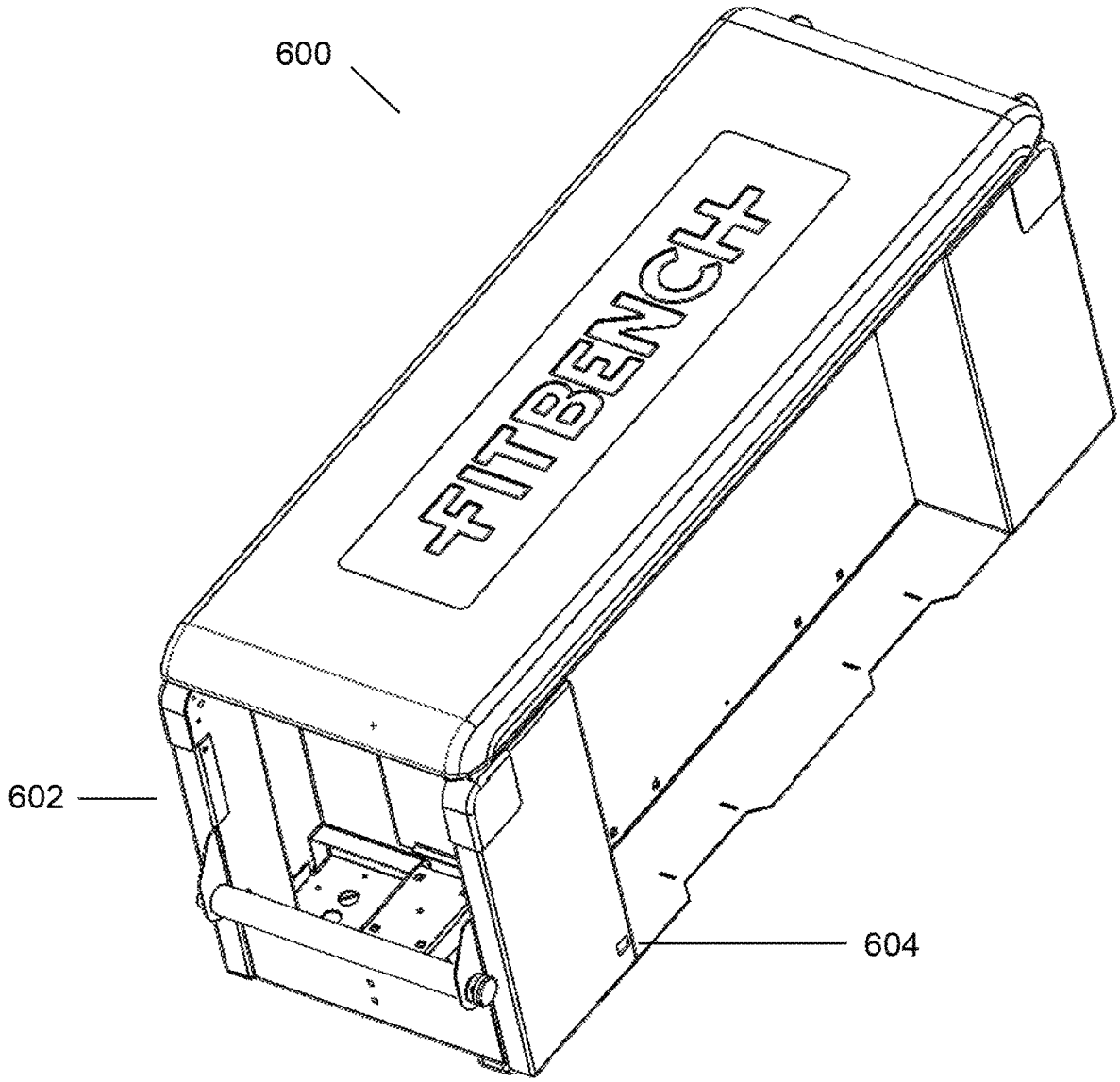
FIG. 6 illustrates a workout bench in accordance with the principles disclosed herein.

FIG. 6 shows an embodiment of a workout bench 600 in accordance with the principles disclosed herein. Rear assembly 602 comprises visual indicator window 604.

Figure 7:
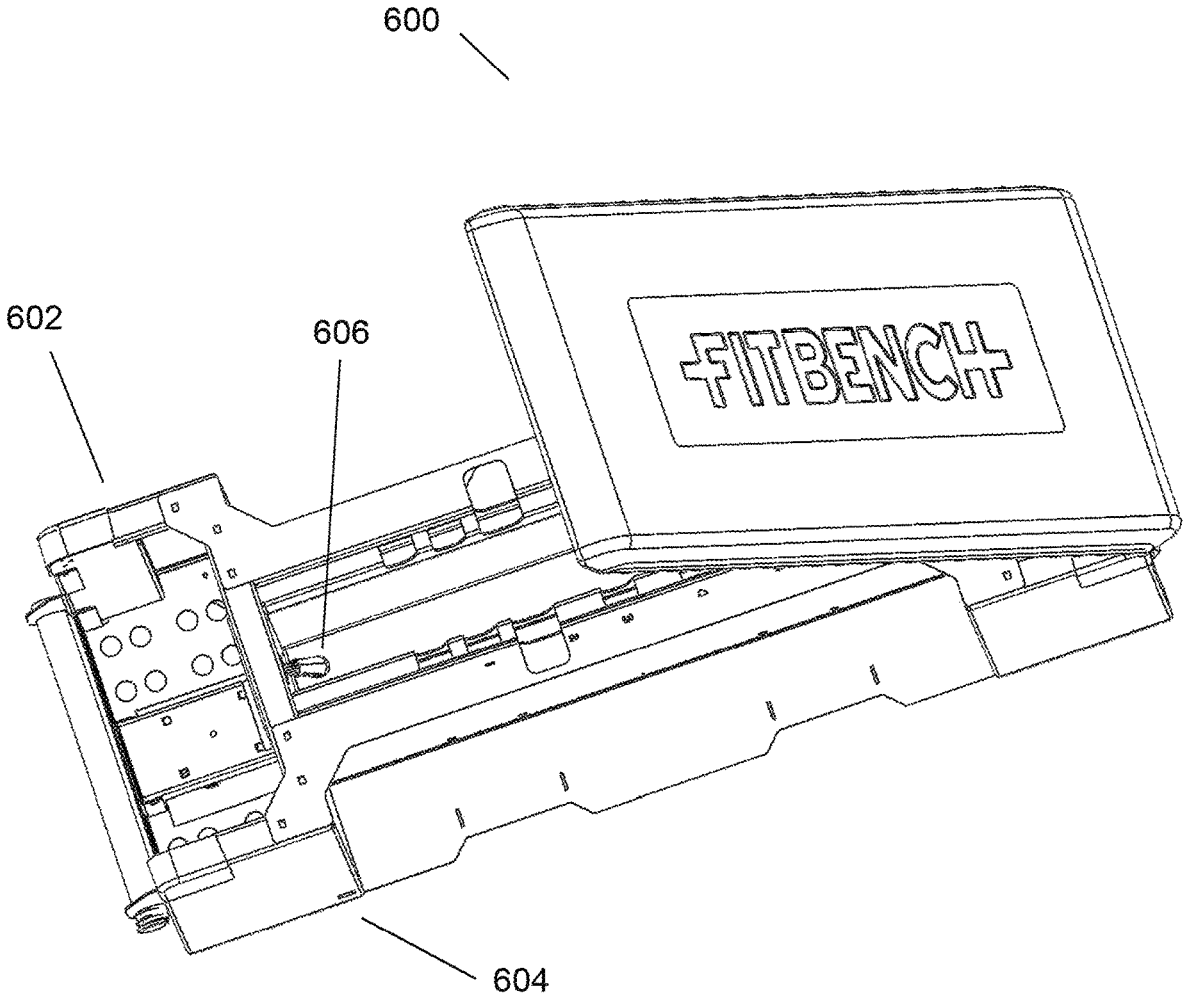
FIG. 7 illustrates another view of the workout bench shown in FIG. 6 with the benchtop lifted.

FIG. 7 shows workout bench 600 with the benchtop open, exposing swivel caster mechanism 606, which allows a person to engage or disengage a swivel caster (not shown) to move workout bench 600 along the support surface (such as a floor).

Figure 8:
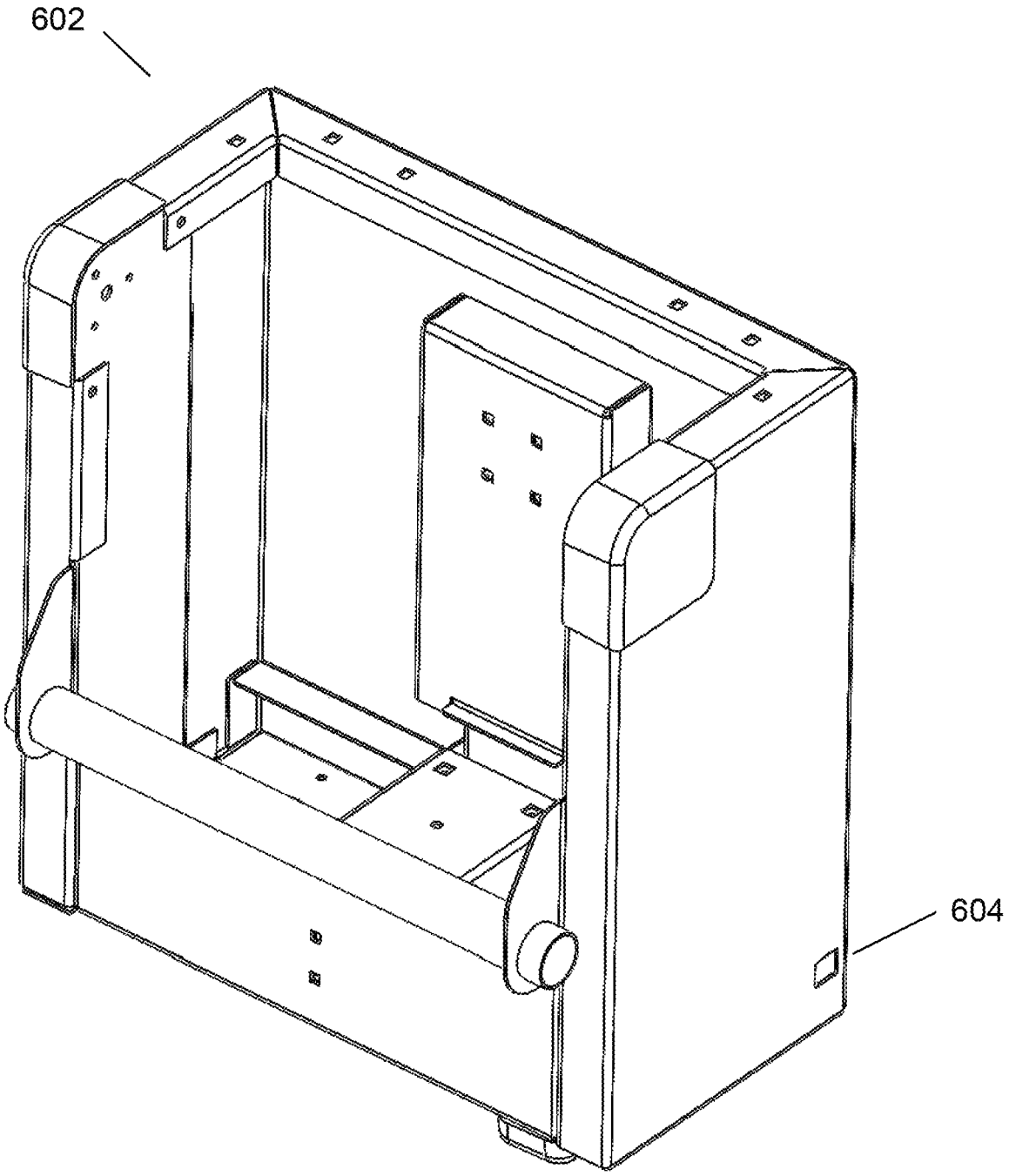
FIG. 8 illustrates a rear assembly of the bench shown in FIG. 6.
Figure 9:
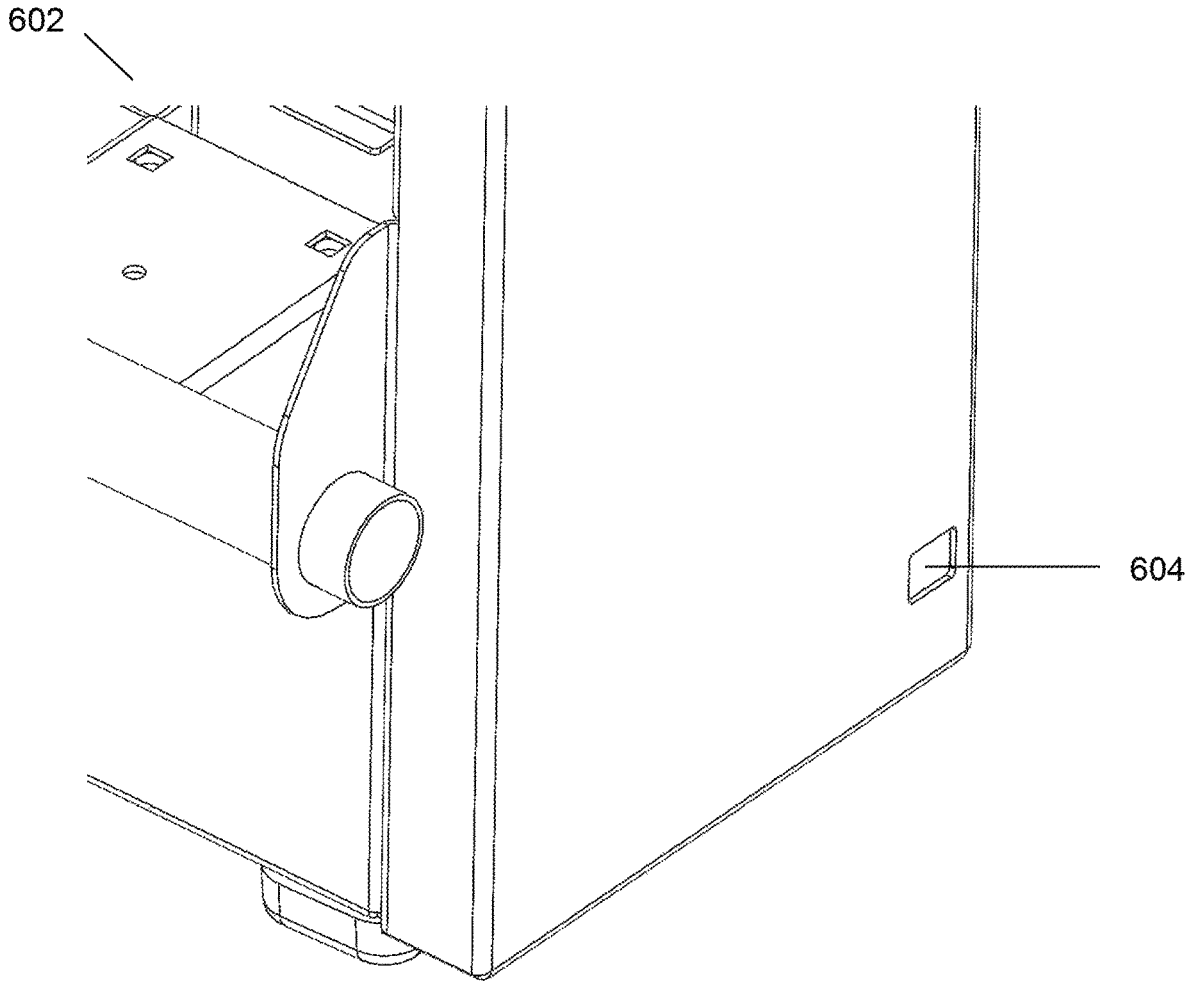
FIG. 9 illustrates a close up view showing a visual indicator window.

FIG. 8 more clearly shows the position of visual indicator window 604 on rear assembly 602. FIG. 9 shows a closer view of visual indicator window 604. As described above, a visual indicator bracket is a component of a linkage assembly and indicates the state of the linkage to the user of the bench. The visual indicator bracket is visible through visual indicator window 604, and preferably displays a color, icon, or other suitable visual indicator to the user of the bench to indicate whether the swivel caster is engaged.

The embodiments disclosed herein comprise a front container, rear container, and side containers. Exercise items may be placed into the front container, the rear container, and/or one or both of the side containers. Preferably, at least one of the front container, rear container, and side containers is adapted to hold resistance band-type exercise items. Embodiments of a workout bench further include a plurality of eye hooks fixed with at least one of the front container, rear container, or side containers. Thus, one of the resistance band-type exercise items may be removed from its front container, rear container, or side container and fixed with one of the eye hooks so that the person can perform resistance band-type exercises with the workout bench immobile on the support surface due at least in part to the gription pads. The workout bench also preferably further includes a scoop arrangement on one or more of the containers (such as the rear container), projecting away from the side thereof. The scoop arrangement is adapted for urging large exercise items into the container.

The workout bench is compact, portable, easy to move, fully integrated and fully adjustable. This workout bench makes it easy for the user to conduct a complete program of exercise in an efficient amount of time by including storage space for various types of necessary specialized equipment. It allows the user to position the various components of the workout bench in the optimal position for any exercise, and to store and to use whatever equipment is necessary, to exercise the entire body effectively. Further, the workout bench's portable, compact nature allows it to be stored easily in space-restricted homes, and easily moved around within the home or even to a new dwelling. Moreover, the workout bench saves users great amounts of time and money by eliminating the need for a fitness services provider, and prevents unsightly displays and potential falling and tripping hazards by minimizing the entire workout system's footprint when not in use through highly adaptable internal storage. Finally, the storage features also make it very easy for someone to move the workout bench and all their exercise equipment at the same time.

The detailed description is not intended to be limiting or represent an exhaustive enumeration of the principles disclosed herein. It will be apparent to those of skill in the art that numerous changes may be made in such details without departing from the spirit of the principles disclosed herein.

What is claimed is:

1. A workout bench comprising:

a frame, comprising;

a benchtop pivotally coupled to the frame;

a selectively movable brace coupled to the benchtop and configured to support the benchtop at one of a plurality of predefined angular positions;

a plurality of feet configured to support the frame on a surface;

one or more wheels configured to support the frame;

a retractable and extendable swivel caster configured so that when the swivel caster is extended, the plurality of feet are lifted from the surface, and when the swivel caster is retracted, the plurality of feet are lowered to the surface;

a visual indicator window; and a mechanically-operated visual indicator visible through the visual indicator window and configured to visually indicate whether the swivel caster is in an extended state or a retracted state, wherein the visual indicator displays a first image when the swivel caster is in the extended state and a second image when the swivel caster is in the retracted state.

2. The workout bench of claim 1, comprising a swivel caster mechanism configured to control the extension and retraction of the swivel caster.

3. The workout bench of claim 2, wherein the frame defines an interior storage volume.

4. The workout bench of claim 3, wherein the swivel caster mechanism is positioned within the interior storage volume.

5. The workout bench of claim 4, wherein the swivel caster mechanism comprises a handle.

6. The workout bench of claim 2, wherein the swivel caster mechanism is accessible from an exterior of the frame.

7. The workout bench of claim 1, comprising a linkage assembly coupled to the swivel caster and the visual indicator.

8. The workout bench of claim 7, comprising a push/pull toggle clamp coupled to the linage assembly.

9. The workout bench of claim 1, comprising:

a raised beam comprising a plurality of transverse notches;

wherein the movable brace comprises a cross bar; and the plurality of transverse notches and the cross bar are configured so that the cross bar is securely positionable within any of the plurality of transverse notches.

10. The workout bench of claim 1, wherein each of the plurality of feet comprises a gription pad.

11. The workout bench of claim 1, wherein the visual indicator window is positioned on a side of the frame.

12. The workout bench of claim 1, wherein the visual indicator window is positioned on an end of the frame.

13. The workout bench of claim 1, comprising:

a second visual indicator window; and a second mechanically-operated visual indicator visible through the second visual indicator window and configured to visually indicate whether the swivel caster is in the extended state or the retracted state.

14. The workout bench of claim 1, wherein:

the first image comprises a green color; and the second image comprises a red color.

15. The workout bench of claim 1, wherein:

the first image comprises a closed lock icon; and the second image comprises an open lock icon.

16. A workout bench comprising:

a frame, comprising;

a benchtop pivotally coupled to the frame;

a selectively movable brace coupled to the benchtop and configured to support the benchtop at one of a plurality of predefined angular positions;

a plurality of feet configured to support the frame on a surface;

a pair of wheels configured to support the frame;

a retractable and extendable swivel caster configured so that when the swivel caster is extended, the plurality of feet are lifted from the surface, and when the swivel caster is retracted, the plurality of feet are lowered to the surface;

a visual indicator window;

a linkage assembly coupled to the swivel caster;

a mechanically-operated visual indicator coupled to the linkage assembly and visible through the visual indicator window;

wherein the linkage assembly and the visual indicator are configured so that:

the visual indicator displays a first image when the swivel caster is in an extended state; and the visual indicator displays a second image when the swivel caster is in a retracted state.

17. The workout bench of claim 16, comprising a swivel caster mechanism configured to control extension and retraction of the swivel caster.

18. The workout bench of claim 17, wherein the swivel caster mechanism is accessible from within an interior storage volume within the frame.

19. The workout bench of claim 16, comprising a push/pull toggle clamp coupled to the linage assembly.

* * * * *